US006773145B2

(12) United States Patent
Yang

(10) Patent No.: US 6,773,145 B2
(45) Date of Patent: Aug. 10, 2004

(54) LAMPSHADE ASSEMBLY

(76) Inventor: Pu-Ming Yang, 2F, No. 3, Lane 18, Yung Ping St., Lu Chou City, Taipei Hsien (TW)

( * ) Notice: Subject to any disclaimer, the term of this patent is extended or adjusted under 35 U.S.C. 154(b) by 0 days.

(21) Appl. No.: 10/269,966

(22) Filed: Oct. 15, 2002

(65) Prior Publication Data

US 2004/0070980 A1 Apr. 15, 2004

(51) Int. Cl.[7] ..... F21V 1/06; F21V 11/00

(52) U.S. Cl. ..... 362/352; 362/358; 362/360; 362/361; 362/357; 362/367; 362/368; 362/440; 362/450; 362/283; 362/355

(58) Field of Search ..... 362/352, 351, 362/358, 360, 361, 356, 357, 367, 368, 440, 450, 806, 277, 282, 283, 311, 355

(56) References Cited

U.S. PATENT DOCUMENTS 1,072,815 A * 9/1913 Brady ..... 362/360
1,335,640 A * 3/1920 Beales ..... 362/360
1,867,562 A * 7/1932 Burke ..... 362/352
1,903,463 A * 4/1933 Koch ..... 362/360
4,656,568 A * 4/1987 Reed ..... 362/352

* cited by examiner

*Primary Examiner*—Stephen Husar
*Assistant Examiner*—Sharon Payne

(57) ABSTRACT

A lampshade assembly comprises a lampshade and a connection mechanism. The lampshade has a plurality of lampshade pieces. The connection mechanism has a plurality of connecting rods each of which is respectively attached to the lampshade pieces. The connection mechanism further comprises an upper cap, a first fitting piece, a fitting set and a spring. When the spring is stretched outwardly to separate the upper cap from the first fitting piece and then stack the lampshade pieces. When the lampshade pieces are assembled, the connecting rods radiate around a circle. Since the space occupied by the lampshade assembly is reduced, the packing cost and the transport cost are reduced.

17 Claims, 7 Drawing Sheets

LAMPSHADE ASSEMBLY

BACKGROUND OF THE INVENTION

1. Field of the Invention

The invention relates to a lampshade assembly and, more particularly, to a lampshade assembly having a plurality of lampshade pieces that can be stacked up on one another.

2. Description of the Related Art

The design of the lampshade assembly accompanied with the light brightness of the lamp contributes to the creation of a specific atmosphere in its environment. The lampshade assembly may be designed according to various styles following the current fashion.

Once it is achieved, the lampshade assembly is delivered to the vendor. In order to optimize the yield, it is desirable that one delivery can provide a higher amount of products. The transport cost can be thereby compensated with a greater amount of products carried per delivery.

Referring to FIG. 1, a lampshade assembly of the prior art comprises a lampshade 10 and a frame 11. One portion of the frame 11 is connected to the top of the lampshade 10 while another portion is connected to a rod 12 of the lamp 1. The rod 12 is further connected to a socle 13 of the lamp structure 1. When the above conventional lamp to be packed, the packing box needed usually has to have a width L that has at least the dimension of the lampshade 10.

The above lampshade structure of the prior art is formed in a single body, and has a lower potion that is dimensionally larger than the socle of the lamp. The size of the packaging box therefore has to be dimensionally adapted to the size of the lampshade. From a packaging consideration, the empty space within the lampshade represents waste of space that is usually filled with a gap-filling material to prevent the damage of the lampshade due to external shocks. As a result, the transportation of the packaged lampshade requires a substantial space, which undesirably increases the packaging cost and the transport cost.

SUMMARY OF THE INVENTION

It is therefore a principal object of the invention to provide a lampshade assembly that the packing space of the lampshade assembly is greatly reduced, and less packing material is needed. The packing cost and the transport cost are thereby reduced, and it is more convenient to carry the lampshade packing box.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
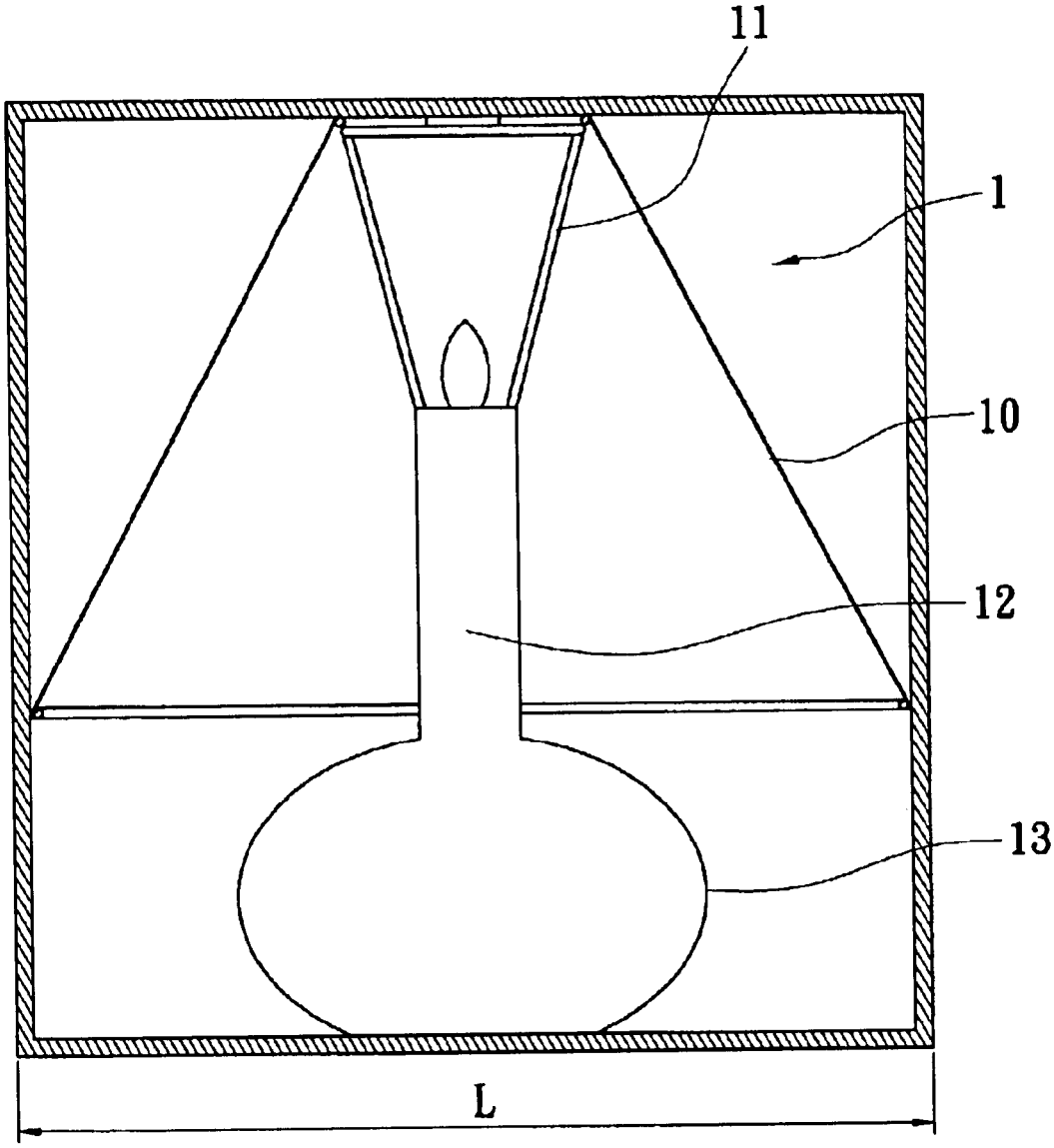
FIG. 1 PRIOR ART
FIG. 1 is a cross-sectional view of a conventional lampshade packing structure.

Wherever possible in the following description, like reference numerals will refer to like elements and parts unless otherwise illustrated.

Figure 2:
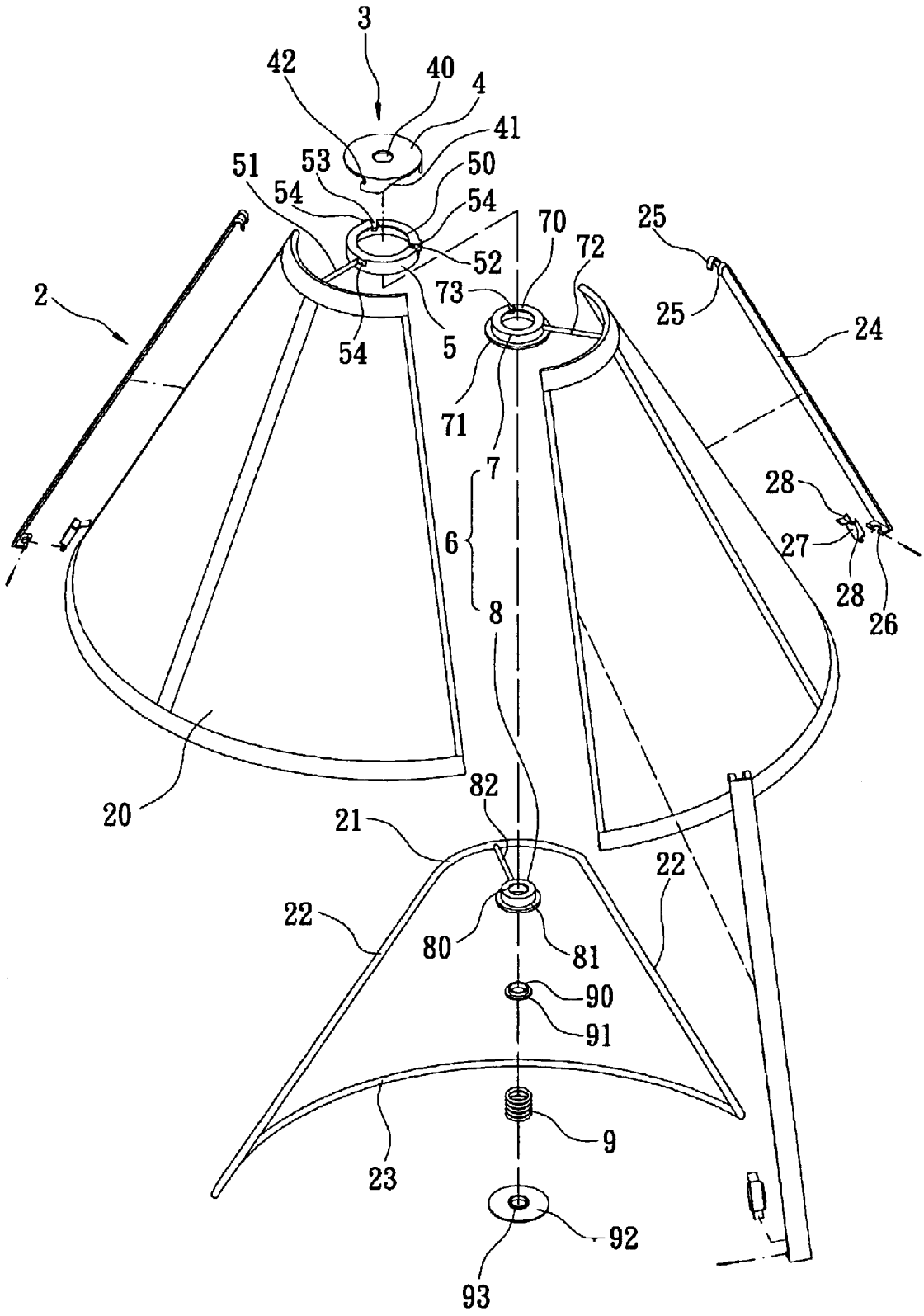
FIG. 2 is an exploded view of a lampshade assembly according to an embodiment of the invention.

Referring to FIG. 2, the invention provides a lampshade assembly including a lampshade 2 and a connection mechanism 3.

The lampshade 2 includes a plurality of lampshade pieces 20. Each of the lampshade pieces 20 includes an upper bar 21, a side bar 22, and a lower bar 23 respectively located at an upper edge, a side edge and a lower edge. Two adjacent lampshade pieces 20 are attached to each other by a connecting element 24. The connecting element 24 has hooks 25 at a top end, and a bent portion 26 at a bottom end. A securing piece 27, having bent portions 28 respectively at two ends, is pivotally connected to the bent portion 26.

The connection mechanism 3 includes an upper cap 4, a first fitting piece 5, a fitting set 6, and a spring 9.

The upper cap 4 is, for example, a disk with a central hole 40. At least one rib 41 having a notch 42 is formed at a periphery of the upper cap 4. The number of ribs 41 is equal to the number of lampshade pieces 20.

The first fitting piece 5 is, for example, a ring. The first fitting piece 5 has an inwardly extended circular flange 50 on its top. One end of a connecting rod 51 is attached to a side surface of the first fitting piece 5, and the other end is attached to the upper bar 21. Two notches 52, 53 are formed on a top of the first fitting piece 5 in a manner that the notches 52, 53 and the connecting rod 51 are equally spaced apart from one another. A bump 54 is further formed on an outer surface of the first fitting piece 5 to snap fit the rib 41 of the upper cap 4.

The fitting set 6 is arranged between the upper cap 4 and the first fitting piece 5. The fitting set 6 includes a second fitting piece 7 and a third fitting piece 8. The second fitting piece 7 is, for example, a ring having an inwardly extended flange 70 and an outwardly extended flange 71 respectively at a top and bottom thereof. One end of a connecting rod 72 is attached to a side surface of the second fitting piece 7, and the other end is attached to an upper bar 21 of another lampshade 20. The connecting rod 72 is longer than the connecting rod 51 of the first fitting piece 5. A notch 73 is formed on a top of the second fitting piece 7 in a manner that the notch 73 and the connecting rod 72 respectively correspond to the notches 52, 53. The third fitting piece 8 is, for example, a ring having an inwardly extended flange 80 and an outwardly extended flange 81 respectively at a top and bottom. One end of a connecting rod 82 is further attached to a side surface of the third fitting piece 8, and the other end is attached to an upper bar 21 of another lampshade piece 20. The connecting rod 82 is longer than the connecting rod 72.

The spring 9 inserts respectively inside the upper cap 4, the first fitting piece 5 and the fitting set 6. An urging portion 90 is provided on a top of the spring 9. The urging portion 90 is, for example, a ring having an outwardly extended flange 91. A lower cap 92 having a circular flange 93 around a central portion thereof is connected to a bottom of the spring 9.

Figure 5:
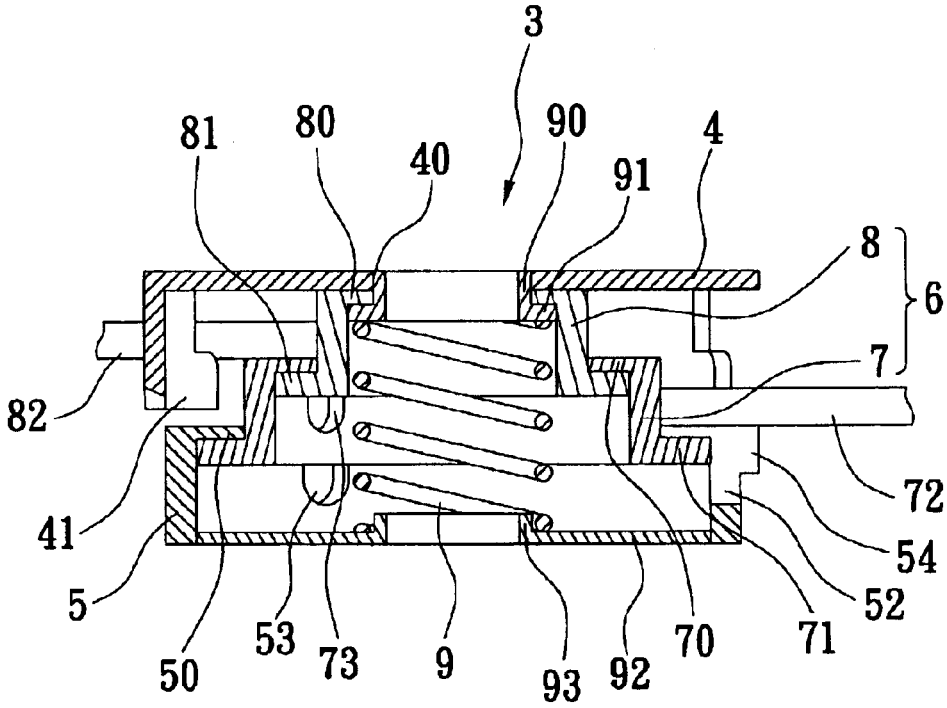
FIG. 5 is a cross-sectional view of a connection mechanism of a lampshade assembly, showing the lampshade assembly being divided into pieces and packed according to a connection mechanism.

In FIG. 5, the second fitting piece 7 fits inside the first fitting piece 5 in a manner that an upper portion of the second fitting piece 7 protrudes through the inwardly extended circular flange 50 of the first fitting piece 5. A top of the third fitting piece 8 fits through the inwardly extended flange 70 of the second fitting piece 7. A top of the urging portion 90 fits respectively through the inwardly extended flange 80 of the third fitting piece 8 and the central hole 40 of the upper cap 4. The top of the spring 9 is urged against the bottom of the urging portion 90. The bottom of the spring 9 is connected to the circular flange 93. The lower cap 92 snap fits with the bottom of the first fitting piece 5.

Figure 3:
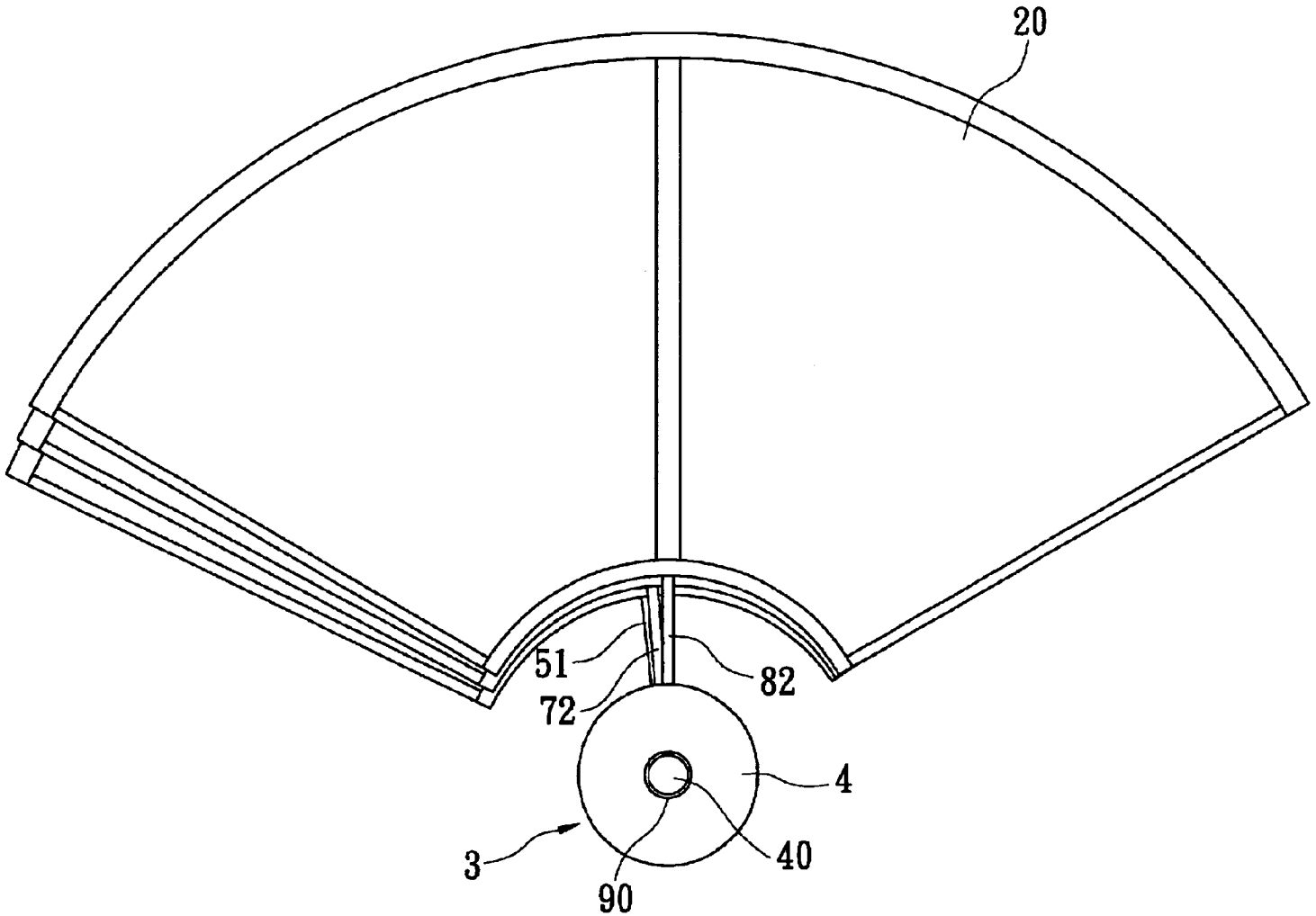
FIG. 3 is a top view of a lampshade assembly in a packed configuration according to an embodiment of the invention.

When no external force is applied to the spring 9, the upper cap 4 and the first fitting piece 5 are separated from each other. The outwardly extended flange 71 of the second fitting piece 7 abuts against the inwardly extended circular flange 50 of the first fitting piece 5. The outwardly extended flange 81 of the third fitting piece 8 abuts against the inwardly extended flange 70 of the second fitting piece 7. The outwardly extended flange 91 of the urging portion 90 abuts against the inwardly extended flange 80 of the third fitting piece 8. As shown in FIG. 3, the upper cap 4, the first fitting piece 5 and the fitting set 6 are disassembled by outwardly stretching the spring 90. Then, the lampshade pieces 20 can be stacked up on one another.

Figure 8:
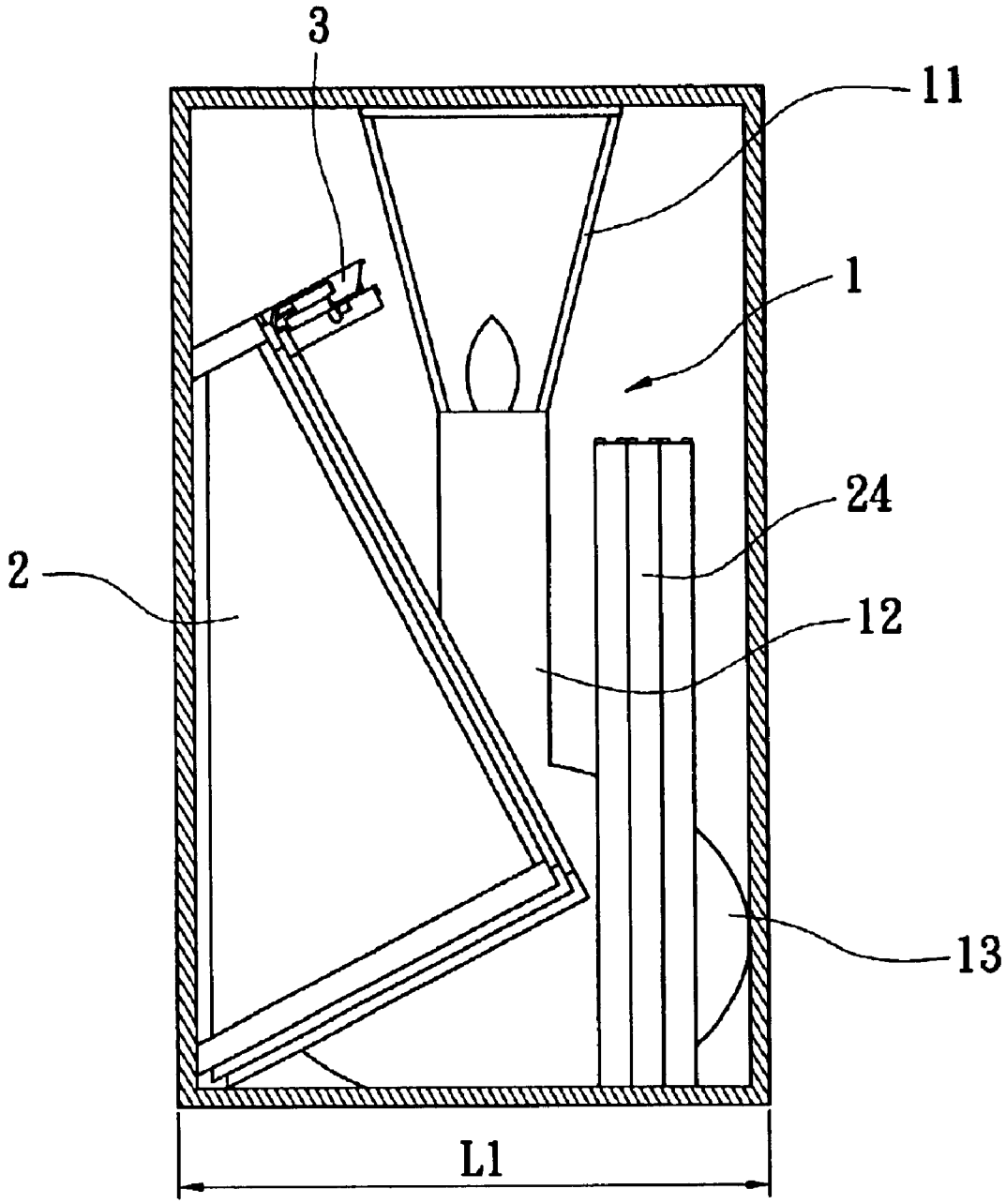
FIG. 8 is a top view of a lampshade assembly packed into a box according to an embodiment of the invention.

Referring to FIG. 8 and FIG. 1, when the lamp structure 1 having the lampshade assembly is packed, the volume occupied by the lampshade 2 is greatly reduced. Less packing material is therefore needed. Furthermore, the width L1 of a packing box for the lampshade assembly according to the invention is significantly reduced. It is therefore more convenient to carry such a lampshade packing box. More boxes can be placed in the same transportation container for transport, and the transport cost per lamp is reduced.

Figure 4:
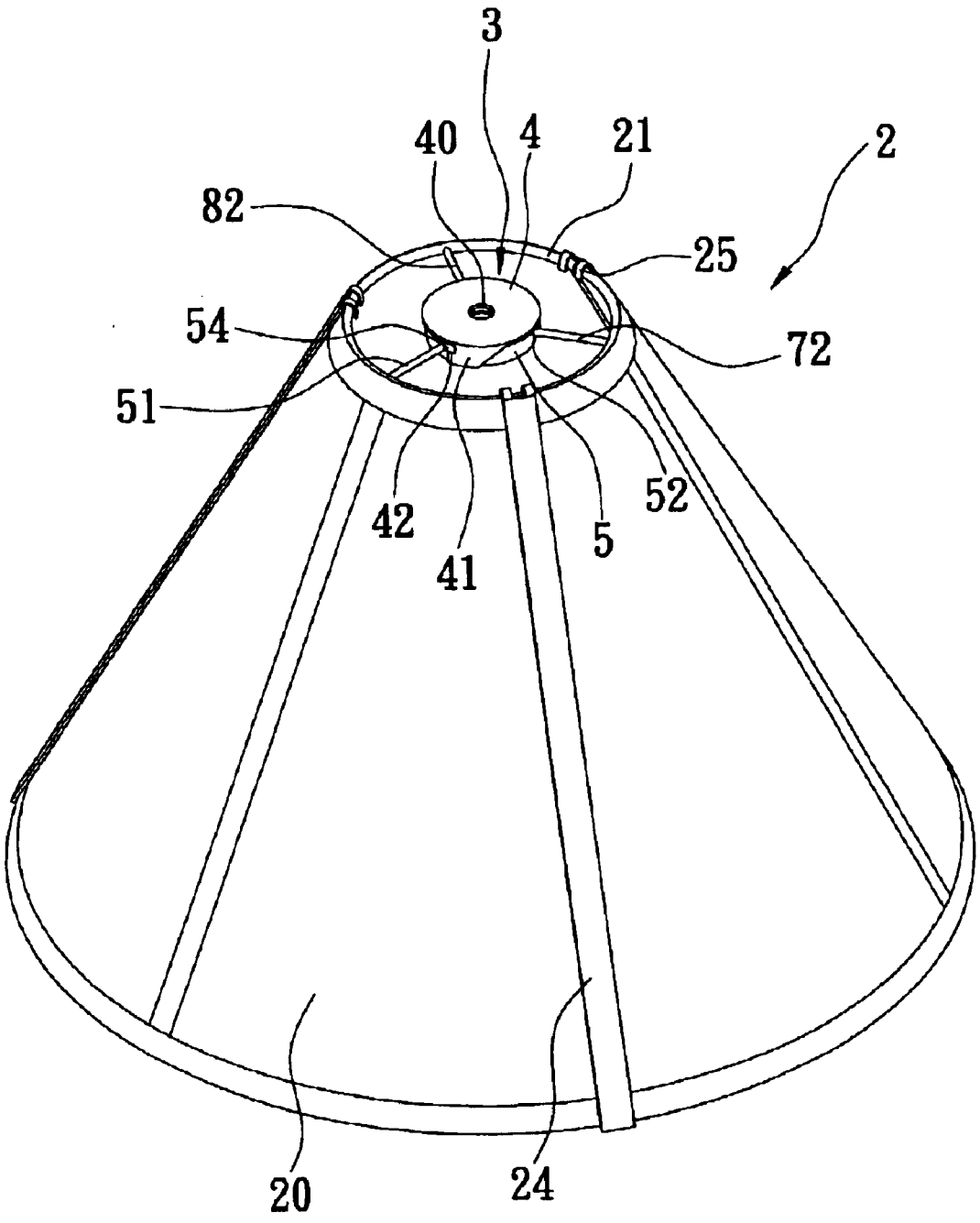
FIG. 4 is a perspective view of an assembled lampshade according to an embodiment of the invention.
Figure 6:
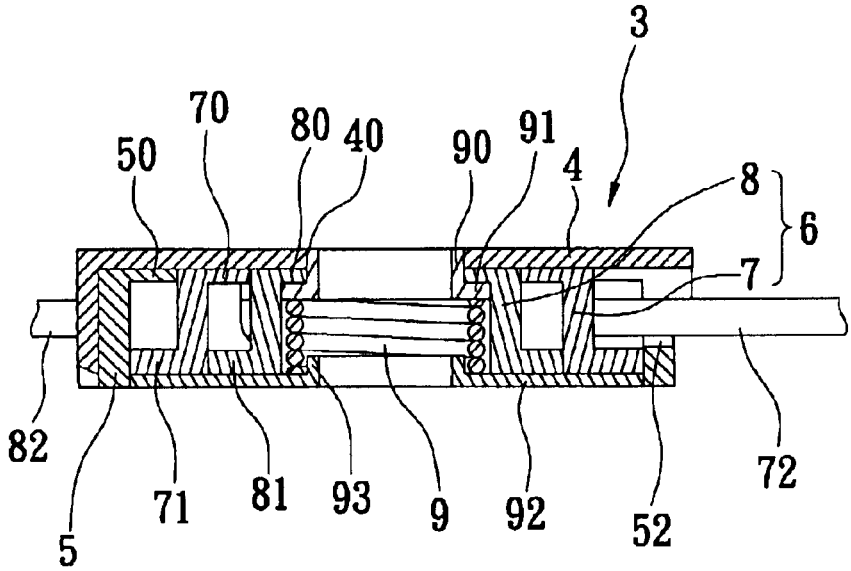
FIG. 6 is a cross-sectional view of a connection mechanism of a lampshade assembly, showing the lampshade pieces being unfolded according to a connection mechanism.
Figure 7:
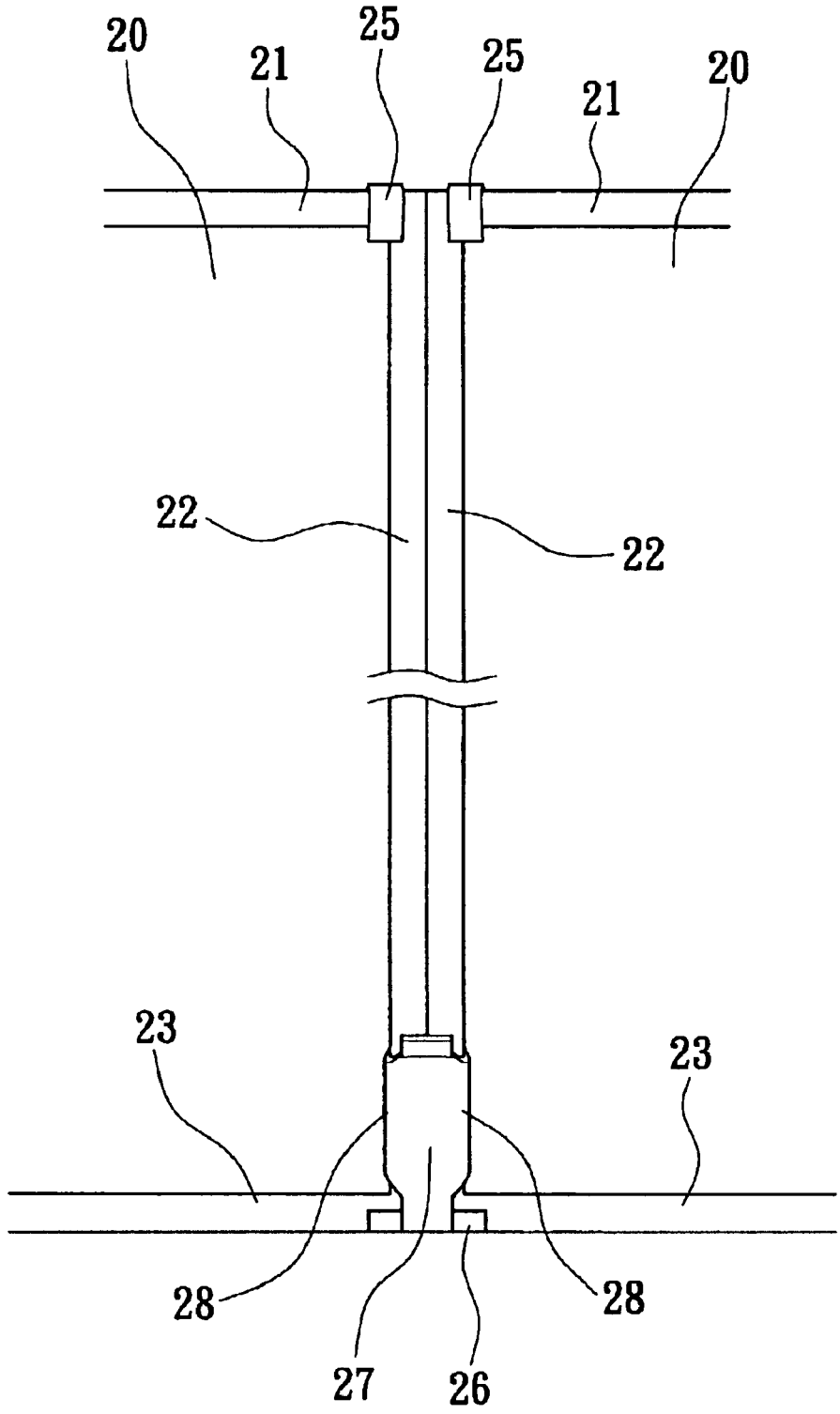
FIG. 7 is a schematic view showing a connecting element that connects the lampshade pieces together according to an embodiment of the invention.

In FIG. 2, FIG. 4 and FIG. 6, when the lampshade 20 is to be assembled, the connecting rod 72 and the notch 73 of the second fitting piece 7 respectively fit into the notches 52, 53. The connecting rod 82 of the third fitting piece 8 corresponds to the notch 73 of the second fitting piece 7. The connecting rods 51, 72, 82 uniformly radiate around a circle. The upper cap 4 presses upon the first fitting piece 5 to allow the second and third fitting pieces 7, 8 to lie proximate to the lower cap 92. The second fitting piece 7 and the first fitting piece 5 then are adjacently under the bottom of the upper cap 4. The connecting rod 72 of the second fitting piece 7 is partially located inside the notch 52 of the first fitting piece 5. The connecting rod 82 of the third fitting piece 8 is partially located respectively inside the notch 73 of the second fitting piece 7 and the notch 53 of the first fitting piece 5. Then, the upper cap 4 is rotated to fit the notch 42 of the rib 41 to the bump 54 of the first fitting piece 5 to prevent the spring 9 from resiliently leaving the connection mechanism 3. Referring to FIG. 7, the lampshade pieces 20 are attached side by side in a manner that the hooks 25 of the connecting element 24 respectively hook the upper bars 21 of the adjacent lampshade pieces 20, and the bent portion 28 of the securing piece 27 respectively hook the side bars 22.

The lampshade is divided into a plurality of lampshade pieces and assembled by means of the connection mechanism as described above, regardless of the size of the lampshade. The fitting set includes ring-shaped fitting pieces with different sizes so that the fitting pieces can pivotally fit with one another. The smaller fitting piece (the third fitting piece) has the connecting rod longer than the larger one (the second fitting piece). The larger fitting piece is provided with a notch on its top for receiving the connecting rod of the smaller fitting piece so that the connecting rods of the smaller and larger fitting pieces are equally spaced apart from one another. The larger fitting piece fits into the first fitting piece, with the notch of the first fitting piece corresponding to the connecting rod of the first fitting piece. Then, the upper cap is connected to the first fitting piece. By this way, the lampshade can be assembled and disassembled into the lampshade pieces.

As described above, the lampshade assembly according to the invention therefore includes at least the following advantages. By means of the connection mechanism, the lampshade pieces can be stacked into a smaller configuration. Therefore, not only the transport cost is reduced, but also the filling material used to absorb shock is reduced.

Those skilled in the art will readily appreciate that the above description is only illustrative of specific embodiments and examples of the invention. The invention should therefore cover various modifications and variations made to the herein-described structure and operations of the invention, provided they fall within the scope of the invention as defined in the following appended claims.

What is claimed is:

1. A lampshade assembly comprising:

a lampshade, including a plurality of lampshade pieces each of which is provided with an upper bar, a side bar, and a lower bar respectively placed at an upper edge, a side edge and a lower edge, and two adjacent lampshade pieces are attached to each other by a connecting element; and a connection mechanism, including a plurality of connecting rods each of which is respectively attached to the lampshade pieces, wherein the connecting element respectively includes at a top end a plurality of hooks to hook the upper bars of the adjacent lampshade pieces, and at a bottom end a first bent portion, the first bent portion being pivotally connected to a securing piece at each end of which a second bent portion is formed.

2. A lampshade assembly comprising:

a lampshade, including a plurality of lampshade pieces; and a connection mechanism, including a plurality of connecting rods each of which is respectively attached to the lampshade pieces, wherein the connection mechanism further comprises an upper cap, a first fitting piece, a fitting set and a spring, the fitting set being located between the upper cap and the first fitting piece, and the spring is located inside the upper cap, the first fitting piece and the fitting set.

3. The lampshade assembly of claim 2, wherein the upper cap is a disk with a central hole, and at least one rib having a notch is formed at a periphery of the upper cap.

4. The lampshade assembly of claim 3, wherein the first fitting piece is a ring having an inwardly extended circular flange on a top of the ring, a side surface of the first fitting piece being attached to one end of a connecting rod, two notches being formed on a top of the first fitting piece in a manner that the notches and the connecting rod uniformly radiate, and an outer surface of the first fitting piece further including a bump to snap fit the rib of the upper cap.

5. The lampshade assembly of claim 4, wherein the fitting set includes a plurality of ring-shaped fitting pieces with different sizes so that the ring-shaped fitting pieces pivotally fit with one another, one smaller ring-shaped fitting piece having a connecting rod longer than one larger ring-shaped fitting piece, a top of the larger ring-shaped fitting piece being provided with a notch for receiving the connecting rod of the smaller ring-shaped fitting piece so that the connecting rods of the ring-shaped fitting pieces are spaced apart from one another, the larger ring-shaped fitting piece fitting into the first fitting piece, with the notch of the first fitting piece corresponding to the connecting rod of the smaller ring-shaped fitting piece.

6. The lampshade assembly of claim 5, wherein the larger fitting piece of the fitting set is provided with an inwardly extended flange and an outwardly extended flange respectively at a top and bottom, and the smaller fitting piece of the fitting set is provided with an inwardly extended flange and an outwardly extended flange respectively at a top and bottom, an upper portion of the smaller fitting piece being fitted through the inwardly extended flange of the larger fitting piece.

7. The lampshade assembly of claim 2, wherein a ring-shaped urging portion having an outwardly extended flange on its bottom is further provided on a top of the spring to connected with a bottom of the upper cap.

8. The lampshade assembly of claim 2, wherein the lower cap, on a central portion of which a circular flange is formed, is connected to a bottom of the spring and snap fits the bottom of the first fitting piece.

9. A lampshade assembly comprising:

a lampshade, including a plurality of lampshade pieces; and a connection mechanism, including an upper cap, a first fitting piece, a fitting set end a spring, wherein the fitting set is located between the upper cap and the first fitting piece, and the spring is mounted respectively inside the upper cap, the first fitting piece and the fitting set, the lampshade pieces being further connected to a plurality of connecting rods.

10. The lampshade assembly of claim 9, wherein each of lampshade pieces is provided with a an upper bar, a side bar, and a lower bar respectively placed at an upper edge, a side edge and a lower edge, and two adjacent lampshade pieces are attached to each other by a connecting element.

11. The lampshade assembly of claim 10, wherein the connecting element respectively includes at a top end a plurality of hooks to hook the upper bars of the adjacent lampshade pieces, and at a bottom end a first bent portion, the first bent portion being pivotally connected to a securing piece at each end of which a second bent portion is formed.

12. The lampshade assembly of claim 9, wherein the upper cap is a disk with a central hole, and at least one rib having a notch is formed at a periphery of the upper cap.

13. The lampshade assembly of claim 12, wherein the first fitting piece is a ring having an inwardly extended circular flange on a top of the ring, a side surface of the first fitting piece being attached to one end of a connecting rod, two notches being formed on a top of the first fitting piece in a manner that the notches and the connecting rod uniformly radiate, and an outer surface of the first fitting piece further including a bump to snap fit the rib of the upper cap.

14. The lampshade assembly of claim 13, wherein the fitting set includes a plurality of ring-shaped fitting pieces with different sizes so that the ring-shaped fitting pieces pivotally fit with one another, one smaller ring-shaped fitting piece having a connecting rod longer than one larger ring-shaped fitting piece, a top of the larger ring-shaped fitting piece being provided with a notch for receiving the connecting rod of the smaller ring-shaped fitting piece so that the connecting rods of the ring-shaped fitting pieces are spaced apart from one another, the larger ring-shaped fitting piece fitting into the first fitting piece, with the notch of the first fitting piece corresponding to the connecting rod of the smaller ring-shaped fitting piece.

15. The lampshade assembly of claim 14, wherein the larger fitting piece of the fitting set is provided with an inwardly extended flange and an outwardly extended flange respectively at a top and bottom, and the smaller fitting piece of the fitting set is provided with an inwardly extended flange and an outwardly extended flange respectively at a top and bottom, an upper portion of the smaller fitting piece being fitted through the inwardly extended flange of the larger fitting piece.

16. The lampshade assembly of claim 9, wherein a ring-shaped urging portion having an outwardly extended flange on its bottom is further provided an a top of the spring to connected with a bottom of the upper cap.

17. The lampshade assembly of claim 9, wherein the lower cap, on a central portion of which a circular flange is formed, is connected to a bottom of the spring and snap fits the bottom of the first fitting piece.

* * * * *